US008944265B2

(12) United States Patent
Blake

(10) Patent No.: US 8,944,265 B2
(45) Date of Patent: Feb. 3, 2015

(54) LIQUIDS PACKAGING

(75) Inventor: Graeme Ashley Blake, Hamilton (NZ)

(73) Assignee: Vin Singlz Limited, Hamilton (NZ)

( * ) Notice: Subject to any disclaimer, the term of this patent is extended or adjusted under 35 U.S.C. 154(b) by 1098 days.

(21) Appl. No.: 11/815,943

(22) PCT Filed: Feb. 10, 2006

(86) PCT No.: PCT/NZ2006/000015

§ 371 (c)(1),
(2), (4) Date: Oct. 6, 2007

(87) PCT Pub. No.: WO2006/085779

PCT Pub. Date: Aug. 17, 2006

(65) Prior Publication Data

US 2008/0264958 A1 Oct. 30, 2008

(30) Foreign Application Priority Data

Feb. 10, 2005 (NZ) ..... 538172

(51) Int. Cl.
*B65D 83/00* (2006.01)
*B65D 41/56* (2006.01)
*B65D 41/34* (2006.01)

(52) U.S. Cl.
CPC ..... *B65D 41/56* (2013.01); *B65D 41/3447* (2013.01)
USPC ..... 215/387; 220/703

(58) Field of Classification Search
USPC ..... 220/703, 23.86, 212, 255.1, 265; 215/227, 228, 387, DIG. 7, 321; 222/461, 568
See application file for complete search history.

(56) References Cited

U.S. PATENT DOCUMENTS

| | | | | |
|---|---|---|---|---|
| 4,028,863 | A | 6/1977 | Nixdorff | |
| 4,156,490 | A | 5/1979 | Peraboni | |
| 4,273,247 | A * | 6/1981 | Earls | 215/228 |
| 4,643,321 | A | 2/1987 | Gach | |
| 5,054,268 | A | 10/1991 | Hayes | |
| 5,927,527 | A * | 7/1999 | Montgomery et al. | 215/219 |
| 6,164,473 | A * | 12/2000 | Waldrip | 215/378 |
| 6,398,050 | B1 * | 6/2002 | Allora | 215/228 |
| 6,622,460 | B2 | 9/2003 | Gregory | |
| 6,905,038 | B2 | 6/2005 | Lopez | |

FOREIGN PATENT DOCUMENTS

| | | |
|---|---|---|
| DE | 20201342 | 7/2002 |
| EP | 1332977 | 8/2003 |

(Continued)

OTHER PUBLICATIONS

Australian's Patent Office Examiner's Report dated Jan. 6, 2011 on patent application No. 2006213133.

(Continued)

*Primary Examiner* — Jeffrey Allen
(74) *Attorney, Agent, or Firm* — Young & Thompson

(57) ABSTRACT

A drinking vessel for a liquids packaging product. The drinking vessel is adapted to engage with and seal the opening of a bottle. The drinking vessel incorporates a frangibly linked portion which is adapted to, (a) engage with the bottle when the drinking vessel is fitted to the bottle to seal the bottle, and (b) remain with the bottle when the drinking vessel is subsequently removed from the bottle. Preferably the frangibly linked portion which is adapted to engage with the bottle is in the form of a ring.

20 Claims, 5 Drawing Sheets

(56) References Cited

FOREIGN PATENT DOCUMENTS

Figure 1:
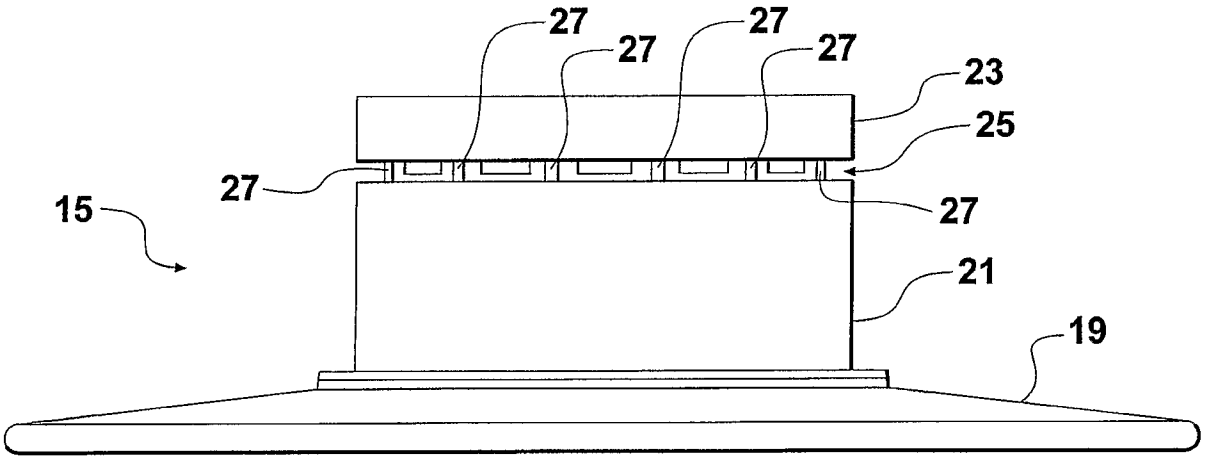

| | | | |
|---|---|---|---|
| FR | 2420488 | A1 | 10/1979 |
| FR | 2657846 | | 8/1991 |
| GB | 2131344 | A | 6/1984 |
| GB | 2161134 | | 1/1986 |
| JP | 2001-301786 | A | 10/2001 |
| JP | 2002-347767 | A | 12/2002 |
| JP | 2002-347796 | | 12/2002 |
| WO | WO 91/18800 | | 12/1991 |
| WO | WO 00/69743 | | 11/2000 |
| WO | WO 0168469 | | 9/2001 |
| WO | WO 2005009853 | | 2/2005 |

OTHER PUBLICATIONS

EESR dated Jun. 8, 2009; Application No. 06716792.4.

India Patent Office First Examination Report dated Jun. 4, 2014; Application No. 6135/DELNP/2007.

International Search Report dated Jun. 27, 2006; International Appln. No. PCT/NZ2006/000015.

Japan Office Action dated Jun. 28, 2011; Application No. 2007-555046.

New Zealand Patent Office—Examination Report dated Feb. 17, 2006; Application No. 538172.

* cited by examiner

LIQUIDS PACKAGING

FIELD OF THE INVENTION

This invention relates to a liquids packaging product, and in particular, but not exclusively to a drinks packaging product for single serve soft drinks and alcoholic beverages.

BACKGROUND

The applicant of the present invention is also the applicant of the New Zealand patent application number 527195 and has been involved in the development of packaging systems for single serve drinks for a number of years. The present invention relates to significant developments over the systems described in the above patent application.

The problem has been to devise a tamper evident seal for use with a drink packaging product which includes both a bottle and a drinking vessel. Early attempts to solve this problem have involved the use of a paper or plastic wrap fitted over the join between the mouth of the drinking vessel and the body of the bottle.

However this type of seal has a number of problems. It involves the use of an additional item of material, and this additional item must be fitted by adding another step to the production line used to fill and seal the drink packages. This additional material and production step adds to the cost of producing each packaged drink.

Also, a tamper evident seal which is removed from the packaged drink when the package is opened is a problem. The person opening the drink has one hand to hold the bottle and one to hold the drinking vessel, and another item can be a nuisance and is likely to become a litter hazard. This problem can be significant in an airline situation where seated passengers are provided with drinks, and where a tear off seal is yet another object to handle and one that will often end up on the floor or under seat cushions etc.

OBJECT

It is therefore an object of the present invention to provide a liquids packaging product which will go some way towards overcoming the above mentioned problems, or at least provide the public with a useful choice.

STATEMENTS OF THE INVENTION

Accordingly, in a first aspect, the invention may broadly be said to consist in a drinking vessel for a liquids packaging product, the drinking vessel being adapted to engage with and seal the opening of a bottle, wherein the drinking vessel incorporates a frangibly linked portion which is adapted to (a) engage with the bottle when the drinking vessel is fitted to the bottle to seal the bottle, and to (b) remain with the bottle when the drinking vessel is subsequently removed from the bottle.

Preferably the frangibly linked portion which is adapted to engage with the bottle is in the form of a ring. A ring is advantageous since it can fit over a ridge or similar protrusion about the circumference of the bottle to engage with the bottle, and the ring can be retained on the bottle after the drinking vessel is removed.

Preferably the frangible link is in the form of a line of weakness in the material joining the frangibly linked portion to the drinking vessel. This allows the frangibly linked portion to be manufactured integrally with the drinking vessel, or at least with a part of the drinking vessel.

Preferably the drinking vessel is sized and shaped to allow the frangibly linked portion to expand slightly when engaging the frangibly linked portion with the bottle.

Preferably the drinking vessel is made from a two piece construction. A two piece construction allows different materials to be used to suit different parts of the vessel, for example a softer plastics material may be chosen for a base portion which is used to form the frangible link and to engage with and seal the bottle while a clear rigid plastics material can be used to form the body of the drinking vessel for improved appearance and feel.

Preferably each piece of the two piece drinking vessel is adapted to allow a mechanical joint to be achieved between the two pieces of the drinking vessel.

Preferably the mechanical joint includes a protruding member, or members, on one piece of the two piece drinking vessel which are adapted to engage with a recess, or recesses, on the other piece of the two piece drinking vessel.

Preferably each piece of the two piece drinking vessel is adapted to form a leak resistant seal between the two pieces of the drinking vessel.

Optionally the pieces of the two piece drinking vessel are adapted to allow a welded joint to be achieved between the two pieces of the drinking vessel.

In a second aspect, the invention may broadly be said to consist in a liquids packaging product incorporating at least one drinking vessel substantially as specified herein and at least one bottle adapted to engage with the drinking vessel.

Preferably the bottle is shaped to engage with the frangibly linked portion of the drinking vessel.

Preferably the portion of the body of the bottle nearest to the neck of the bottle has a smaller diameter than the rest of the body of the bottle.

DESCRIPTION

The invention may also broadly be said to consist in the parts, elements and features referred to or indicated in the specification of the application, individually or collectively, and any or all combinations of any two or more of the parts, elements or features, and where specific integers are mentioned herein which have known equivalents, such equivalents are incorporated herein as if they were individually set forth.

Figure 1A:
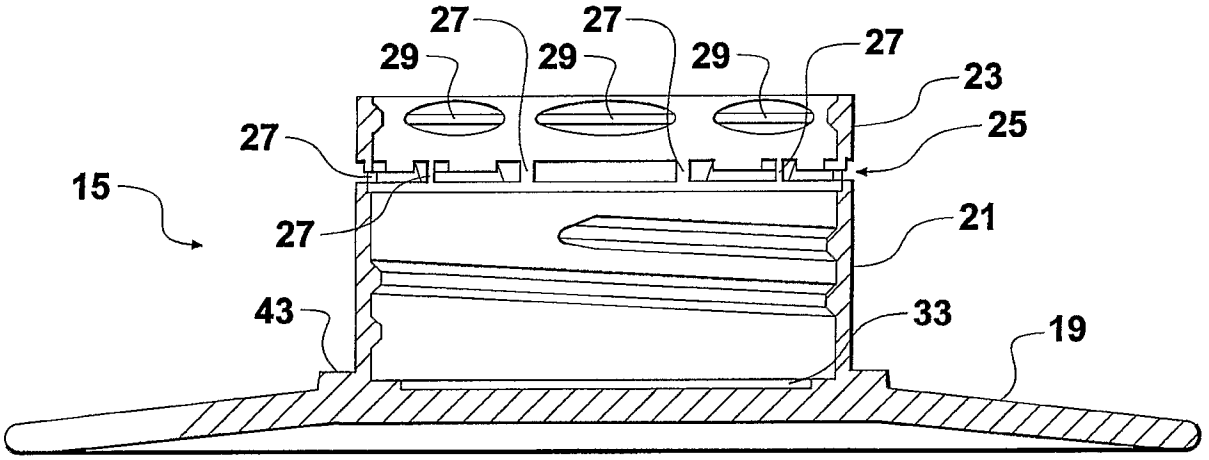
Figure 3:
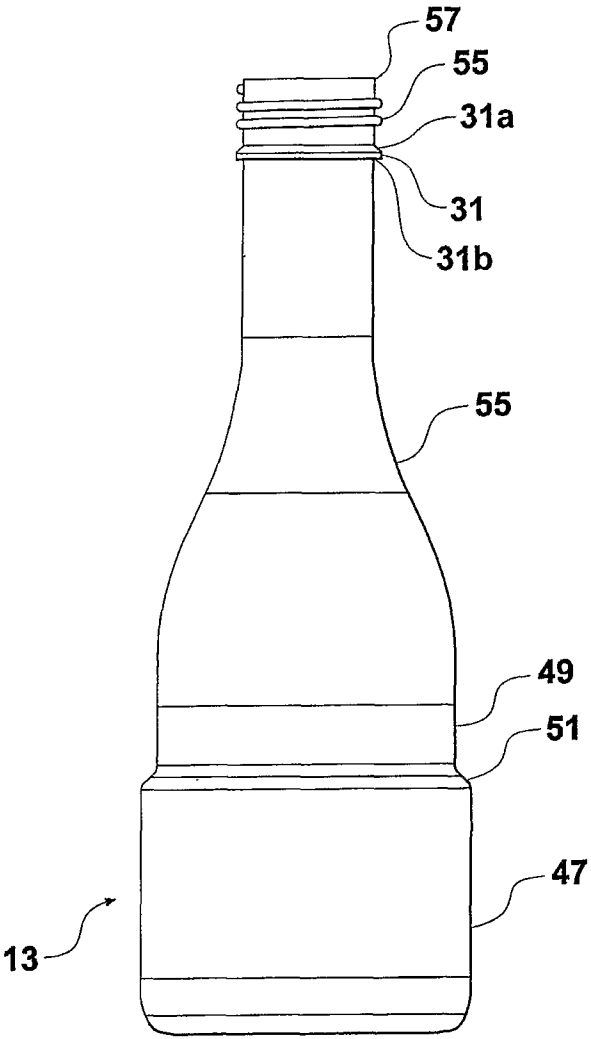
Figure 2:
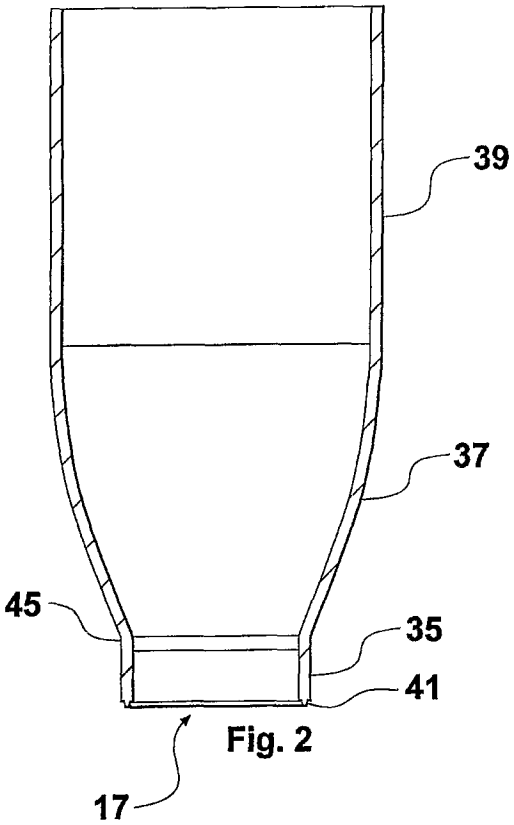
Figure 4:
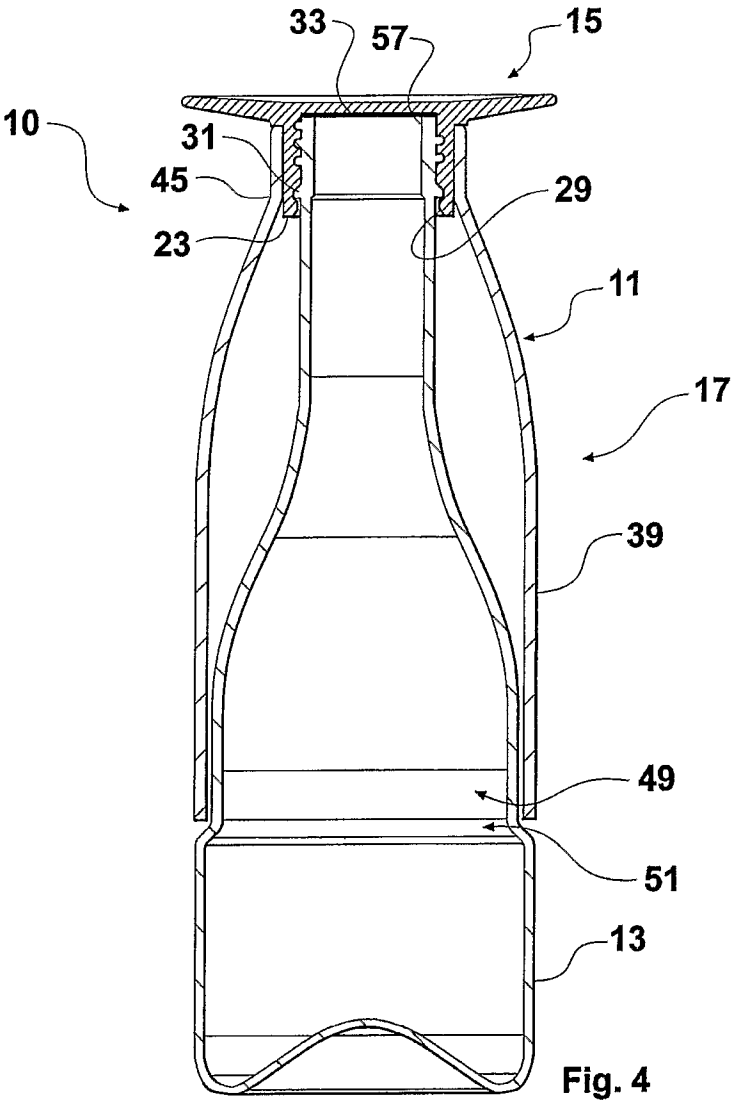
Figure 5:
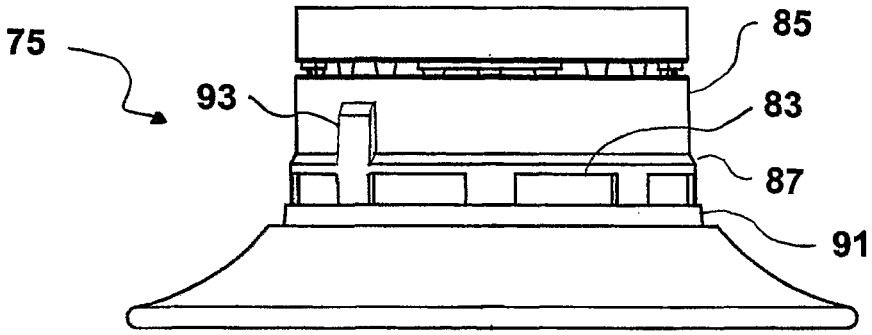
Figure 5A:
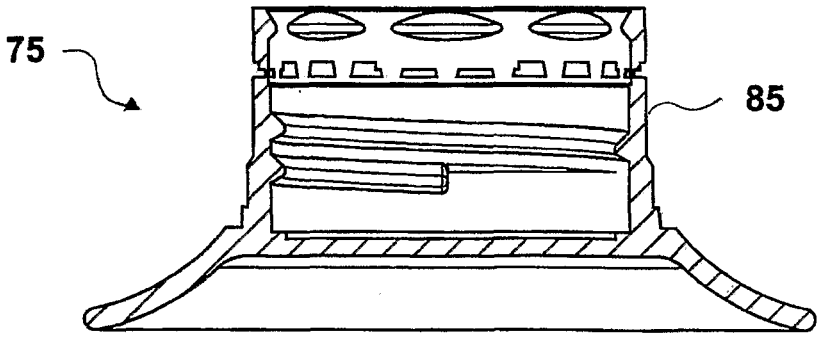
Figure 6:
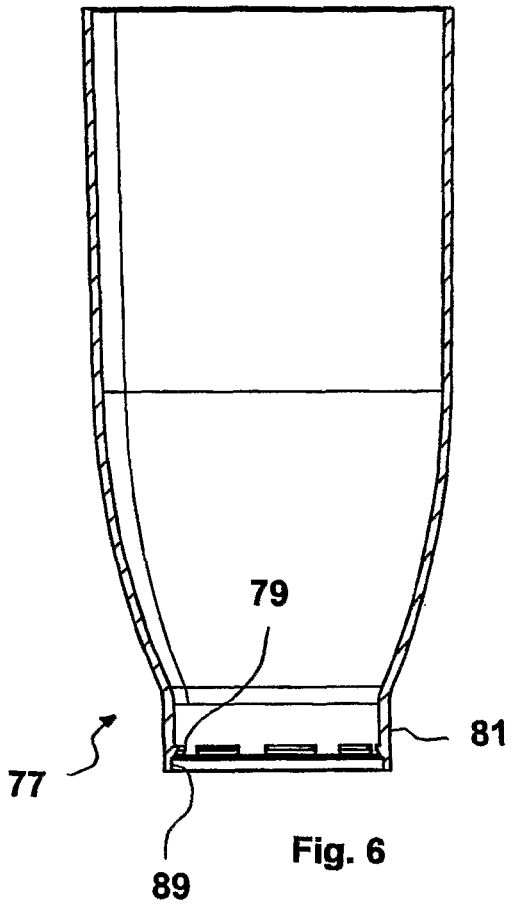
Figure 7:
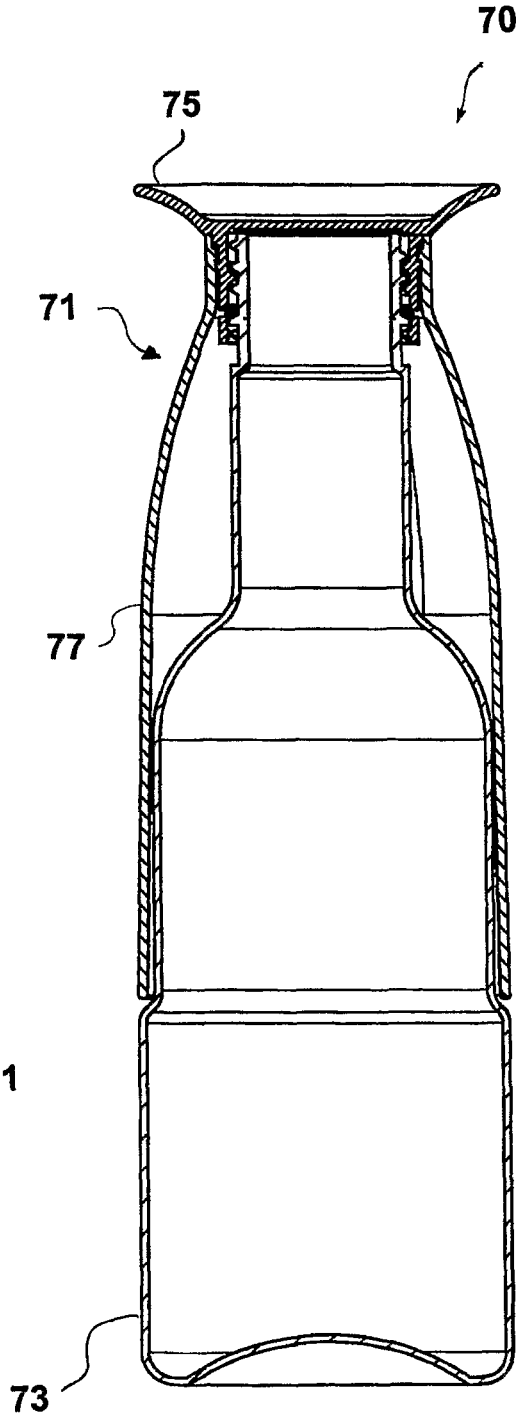

One preferred form of the invention will now be described, by way of example only, with reference to the accompanying drawings in which, FIG. 1 is a side view of a drinking vessel base, FIG. 1*a* is a cross sectional view of the drinking vessel base, FIG. 2 is a cross sectional view of a drinking vessel body, FIG. 3 is a side view of a bottle adapted for use with the drinking vessel, FIG. 4 is a cross sectional view showing the drinking vessel fitted to the bottle, FIG. 5 is a side view of an alternative drinking vessel base, FIG. 5*a* is a cross sectional view of the alternative drinking vessel base, FIG. 6 is a cross sectional view of an alternative drinking vessel body for use with the alternative drinking vessel base, and FIG. 7 is a cross sectional view showing an alternative drinking vessel fitted to a bottle.

EXAMPLE 1

With reference to FIGS. 1 to 4, a first example of a liquids packaging product (10) is shown having a drinking vessel (11) and a bottle (13), the drinking vessel (11) comprising a vessel base (15) and a vessel body (17). The drinking vessel (11) is sized and shaped to fit about the upper part of the bottle (13) and to engage with the top of the bottle (13) and to seal the bottle (13). The drinking vessel (11) includes a tamper evident device which can engage with the bottle (13) and remain with the bottle (13) when the drinking vessel (11) is removed from the bottle (13).

With reference to FIGS. 1 and 1*a*, the vessel base (15) is shown in detail. The vessel base (15) includes a substantially flat circular foot (19) on which the drinking vessel (11) can stand, and a threaded portion (21) in the form of a short open ended cylinder having an internal thread. The threaded portion (21) is adapted to engage with the top of the bottle (13), allowing the vessel base (15) to close and seal the bottle (13). The base (15) also includes a tamper evident seal in the form of a ring (23) which, when initially manufactured, is joined to the rest of the base (15) by a frangible joint (25).

In this example, the frangible joint (25) takes the form of a number of links (27) which link between the threaded portion (21) and the ring (23), the combined cross sectional area of all the links (27) being significantly less than the cross sectional area of the threaded portion (21) and of the ring (23), in planes parallel to the plane of the frangible joint (25). The frangible joint (25) can take other forms, for example a lightly bonded joint or any joint where the cross sectional area of the frangible joint (25) is less than the cross sectional areas of the threaded portion (21) and of the ring (23), in planes parallel to the plane of the frangible joint (25). Essentially the frangible joint (25) includes a line of weakness in the plane of the frangible joint (25).

Formed on the inner diameter of the ring (21) are a number of inwardly projecting protrusions or lugs (29). These lugs (29) are sized and shaped to engage with a circular ridge (31) (refer to FIG. 3) on the bottle (13). The action of the lugs (29) and the frangible joint (25) will be explained in further detail with reference to FIGS. 3 and 4 below.

The base (15) can also have a wadding style of seal (33), for example a laminated aluminum foil disc or a plastic disc, which is used to assist with sealing the bottle (13). The seal (33) is situated to lie within the threaded portion (21) and against the foot (19). The bottle (13) is sealed when the base portion (15) is screwed onto the bottle (13) and the upper lip of the bottle (13) presses and squeezes the seal (33) against the inner surface of the foot (19).

With reference to FIG. 2, the drinking vessel body (17) is shown having a neck portion (35), a tapered shoulder portion (37) and a substantially parallel portion (39). The inner diameter of the neck portion (35) is sized to produce an interference fit when mated with the outer diameter of the threaded portion (21) of the vessel base (15). The neck rim (41) has a "V" shaped protruding ridge which can engage with a shoulder (43) (see FIG. 1*a*) on the vessel base (15) when the vessel body (17) is fitted on to the vessel base (15), and is designed to facilitate an ultrasonically welded bond between the vessel body (17) and the vessel base (15). This joint does not need to be able to withstand the internal pressures within the bottle (13), for example the pressure from a carbonated drink or a sparkling wine, since the joint is outside of the bottle seal.

Alternatively the joint between the vessel base (15) and the vessel body (17) can be achieved using alternative fastening means, for example using glue or a mechanical joint. An example of a mechanical joint is described with reference to FIGS. 5 to 7 below.

The shoulder portion (37) and parallel portion (39) are sized and shaped to achieve a desired compromise between vessel appearance, vessel internal volume, the need for the drinking vessel (11) to be able to fit about the bottle (13), and the need for the assembled packaging product (10) to stack well. While the example illustrated has a relatively flat foot (19) on the base of the drinking vessel (11) it is envisaged that other examples could have a more conical shape for improved appearance.

The neck portion (35) and the shoulder portion (37) are separated by a transition section (45). The shape and location of this transition section (45) is important, particularly its inner wall. This is because it is important that the vessel body (17) has a sufficiently large internal diameter in the region of the transition section (45) so that the ring (23) of the vessel base (15) is able to swell as it passes over the ridge (31) on the bottle (13) when the drinking vessel (11) is fitted to the bottle (13).

Since the vessel base (15) and the vessel body (17) are made in two parts it is possible to manufacture each part from a material that suits the particular requirements of each part. For example the vessel body (17) can be made from a clear rigid plastics material for appearance and feel, while the vessel base (15) can be made from a softer or more flexible plastics material to suit the requirements of the frangible joint (25).

The choice of plastics materials for the two parts of the drinking vessel (11) and for the bottle (13) is made after assessing a number of factors. For the bottle (13) one of the key factors is the ability of the bottle to protect and preserve the contents, for example a plastics material suitable for soft drinks may differ from a plastics material that is suitable for wine. A clear styrene plastics material is preferred for the vessel body (17), to provide a drinking vessel with a good appearance and feel, however alternative plastics materials can be used that provide advantages at the joint between the vessel body (17) and the vessel base (15). The base (15) includes the tamper evident ring (23) and the frangible joint (25) and some of the factors that affect the choice of plastics material for this item include the ability of the ring (23) to swell as it passes over the ridge (31) during assembly of the packaging product (10), and yet to resist swelling and for the frangible joint (25) to break when the base (15) is later removed.

With reference to FIG. 3, the bottle (13) is shown having a lower section (47) and a mid section (49), the lower section (47) having a greater diameter than the mid section (49), and the two being separated by a shoulder section (51). Above the mid section (49) the bottle (13) has a tapered neck section (53) at the top of which is situated the circular ridge (31) and above this is an externally threaded section (55) leading to a rim (57) of the bottle (13).

With reference to FIG. 4, the first example of a liquids packaging product (10) is shown in an assembled state. It can be seen that the parallel portion (39) of the drinking vessel (11) fits snugly over the mid section (49) of the bottle (13) and extends to lightly contact the shoulder section (51) of the bottle (13).

In use the bottle (13) is filled with a liquid, for example a soft drink or wine, and then the drinking vessel (11) is screwed onto the bottle, the threaded portion (21) of the drinking vessel (11) engaging with the external threaded section (55) of the bottle (13), and the drinking vessel (11) is screwed on to the bottle (13) until the bottle rim (57) contacts and squeezes the seal (33).

As the drinking vessel (11) is being screwed onto the bottle, and before the bottle rim (57) contacts the seal (33), the ring (23), or at least the lugs (29) of the ring (23), contact the circular ridge (31) and the ring (23) swells to fit over it. The upper surface (31*a*) of the circular ridge (31) is tapered (refer to FIG. 3) and this taper, combined with a compressive load between the threaded portion (21) and the ring (23) ensure that the ring (23) passes over the circular ridge (31). As noted with reference to FIG. 2 above, the transition section (45) of the drinking vessel body (17) is shaped to ensure that it does not interfere with this swelling of the ring (23) as it passes over the ridge (31).

To open the liquids packaging product (10) the drinking vessel (11) is unscrewed from the bottle (13). As the vessel base (15) moves away from the bottle (13) the lugs (29) on the internal diameter of the ring (23) contact a lower surface (31*b*) (refer to FIG. 3) of the ridge (31) and since this surface is not tapered the lugs (29) catch or bind on the ridge (31). As the vessel base (15) moves further away from the bottle (13) a tensile load is felt by the links (27) and when this load is sufficient the links (27) break. When the drinking vessel (11) is removed from the bottle (13) the ring (23) is left on the bottle (13) and is prevented from departing from the bottle by the ridge (31).

While the ring (23) is connected to the threaded portion (21) it provides evidence that the liquids packaging product (10) has not been opened. Preferably the drinking vessel body (17) is made from a clear plastics material so that the condition of the frangible joint (25) can be seen while the drinking vessel (11) is fitted to the bottle (13).

Preferably the foot (19) and the parallel portion (39) of the drinking vessel (11) and the lower section (47) of the bottle (13) all have substantially similar diameters to allow easier stacking or multi-packaging of the liquids packaging product (10).

Such a liquids packaging product (10) has the advantage that its tamper evident seal does not become detached from the bottle (13) when it is opened, making it more convenient for the end user of the product (10) and giving a reduced chance that the temper evident seal, or ring (23), will be dropped as an item of litter. The incorporation of the tamper evident seal into the drinking vessel (11) also reduces the number of steps required to assemble the product (10) helping to reduce manufacturing costs, and in addition, the end user of the product (10) does not have to carry out any additional tasks when opening the product (10) other than to unscrew the drinking vessel (11).

EXAMPLE 2

With reference to FIGS. 5, 5*a*, 6 and 7 a second example of a drinks packaging product (70) comprising an alternative drinking vessel (71) and an alternative bottle (73) is shown. The primary difference between the first example of a drinks packaging product (10) and the second example of a drinks packaging product (70) is the joint between a drinking vessel base (75) and a drinking vessel body (77) of the alternative drinking vessel (71).

In this second example the drinking vessel base (75) is joined to the drinking vessel body (77) using a mechanical joint. This design arose due to the fact that it is sometimes difficult to bond or weld dissimilar materials, and for reasons as discussed above it is sometimes necessary to use different plastics materials for each part of the drinking vessel (71). For example, in some cases it can be desirable to use polypropylene plastics for the base (75) and clear styrene for the body (77).

The mechanical joint in this case is formed by an interference fit between the drinking vessel base (75) and the drinking vessel body (77) and protruding members or locking tabs in one of these two components, which are adapted to engage with recesses formed in the other of the two components. In this example, locking tabs (79) are formed about the inner diameter of a neck portion (81) of the drinking vessel body (77), and the recesses (83) are formed about the outer diameter of a threaded portion (85) of the drinking vessel base (75).

While the figures show a series of locking tabs (79) and recesses (83) positioned about the inner and outer diameters respectively of the drinking vessel body (77) and the drinking vessel base (75), the locking tabs (79) or recesses (83) could be replaced by a single locking lip and a corresponding single locking recess which extend fully or partly around the inner and outer diameters of the drinking vessel body (77) and the drinking vessel base (75). However, it should be noted that multiple discrete locking tabs (79) and recesses (83) have two advantages, they can help to prevent rotation between the base (75) and the body (77), and they can allow greater flexibility. Flexibility of the components can be a factor during assembly as the neck portion (81) of the body (77) can need to stretch slightly as it is fitted over the base (75) as described below.

In FIG. 5 it can be seen that the outer surface of the threaded portion (85) of the drinking vessel base (75) includes a tapered shoulder (87). Similarly, it can be seen in FIG. 6 that the tabs (79) are chamfered on one side. When the drinking vessel body (77) is fitted onto the drinking vessel base (75) the chamfered side of the tabs (79) can contact the tapered shoulder (87), helping the tabs (79) to slide over the slightly larger diameter of the outer surface of the threaded portion (85) in the region of the recesses (83) before the tabs (79) engage with and enter the recesses (83). When the tabs (79) have engaged with and entered the recesses (83), the drinking vessel body (77) is mechanically fastened to the drinking vessel base (75).

Such a mechanical joint can eliminate the need for welding or gluing, and is suitable for applications where different materials are used for the drinking vessel base (75) and the drinking vessel body (77) and where welding would be difficult.

To help to prevent leaks about the joint between the drinking vessel base (75) and the drinking vessel body (77), these two components can be adapted to mate tightly together to form a seal. In this example the inside diameter (89) of the free end of the neck portion (81) of the drinking vessel body (77) is sized to form an interference fit with a shallow taper (91) on the outer surface of the threaded portion (85) of the drinking vessel base (75), to allow a leak resistant seal to be formed.

A lead in rib (93) can be provided on the outer diameter of the threaded portion (85) of the base (75) to help with assembly of the drinking vessel (71). During assembly, as the vessel body (77) is introduced onto the base (75), the body (77) can be lightly rotated until one of the locking tabs (79) butts against the lead in rib (93), and then the body (77) can be guided onto the base (75) in the correct alignment so that the locking tabs (79) will engage properly with the recesses (83).

VARIATIONS

While the liquids packaging product has been described in the context of packaging drinks, the packaging product can equally be designed for other liquids, for example medicines. In such a case the drinking vessel can include markings to indicate dosage volumes.

DEFINITIONS

Throughout this specification the word "comprise" and variations of that word, such as "comprises" and "comprising", are not intended to exclude other additives, components, integers or steps.

ADVANTAGES

Such a drinking vessel has the advantage that it can provide evidence that the bottle to which it is fitted has been opened or tampered with, and yet the tamper evident device, that is the frangibly linked portion, does not need to be removed from the bottle separately from the drinking vessel. Also, the tamper evident device can remain with the bottle, eliminating the need for the user to handle and discard another item. These advantages are particularly evident in an aircraft, ship or train dining situation.

The invention claimed is:

1. A drinking vessel for a liquids packaging product, the drinking vessel being formed of two parts, a first part of said two parts forms a body of the drinking vessel, and a second part of said two parts forms a base of the drinking vessel and is configured to close and seal the liquids packaging product, and the drinking vessel is formed by joining the body of the drinking vessel to the base of the drinking vessel and forming a leak resistant union between the body of the drinking vessel and the base of the drinking vessel, and the base of the drinking vessel includes a frangibly linked portion which is located inside the body of the drinking vessel when the union is formed between the body of the drinking vessel and the base of the drinking vessel, and the frangibly linked portion is adapted to (a) engage with the liquids packaging product when the drinking vessel is fitted to the liquids packaging product to seal the liquids packaging product, and to (b) remain with the bottle when the drinking vessel is subsequently removed from the liquids packaging product.

2. The drinking vessel as claimed in claim 1, wherein the frangibly linked portion which is adapted to engage with the liquids packaging product is in the form of a ring.

3. The drinking vessel as claimed in claim 1, wherein the frangible link is in the form of a line of weakness in the material joining the frangibly linked portion to the rest of the base.

4. The drinking vessel as claimed in claim 1, wherein the drinking vessel is sized and shaped to allow the frangibly linked portion to expand slightly when engaging the frangibly linked portion with the liquids packaging product.

5. The drinking vessel as claimed in claim 1, wherein each part of the two parts drinking vessel is adapted to allow a mechanical joint to be achieved between the two parts of the drinking vessel.

6. The drinking vessel as claimed in claim 5, wherein the mechanical joint includes at least one protruding member on one of the two parts of the drinking vessel which is adapted to engage with a corresponding recess on the other of the two parts of the drinking vessel.

7. A liquids packaging product incorporating at least one drinking vessel according to claim 1 and at least one bottle adapted to engage with the drinking vessel.

8. A liquids packaging product as claimed in claim 7, wherein the bottle is shaped to engage with the frangibly linked portion of the base.

9. A drinking vessel having a combined use as a closure device to close and seal a liquids packaging product and as a drinking vessel when not being used as a closure device, the drinking vessel having two parts, a first part of said two parts which is a drinking vessel body having a first opening in a first end and a second opening in a second and substantially opposite end, and a second part of said two parts which is a drinking vessel base, and the drinking vessel is formed by fitting the base into the second opening in the body and forming a leak resistant seal between the base and the body, and the base is configured to provide the closure device for the liquids packaging product, and the base also includes a tamper evident seal in the form of a frangibly linked portion which is adapted to (a) engage with the liquids packaging product when the drinking vessel is fitted to the liquids packaging product to seal the liquids packaging product, and to (b) break away from the remainder of the base and to remain with the liquids packaging product when the drinking vessel is subsequently removed from the liquids packaging product.

10. The drinking vessel as claimed in claim 9, wherein the frangibly linked portion which is adapted to engage with the liquids packaging product is in the form of a ring.

11. The drinking vessel as claimed in claim 9, wherein the frangible link is in the form of a line of weakness in the material joining the frangibly linked portion to the rest of the base.

12. The drinking vessel as claimed in claim 9, wherein the drinking vessel is sized and shaped to allow the frangibly linked portion to expand slightly when engaging the frangibly linked portion with the liquids packaging product.

13. The drinking vessel as claimed in claim 9, wherein the first opening in the drinking vessel body is sized to fit snugly about the liquids packaging product when the drinking vessel is being used as a closure device to close and seal the liquids packaging product.

14. The drinking vessel as claimed in claim 9, wherein each part of the two part drinking vessel is adapted to allow a rigid joint to be achieved between the two parts of the drinking vessel.

15. The drinking vessel as claimed in claim 14, wherein the rigid joint includes at least one protruding member on one of the two parts of the drinking vessel which is adapted to engage with a corresponding recess on the other of the two parts of the drinking vessel.

16. A liquids packaging product incorporating at least one drinking vessel according to claim 9 and at least one bottle adapted to engage with the drinking vessel.

17. A liquids packaging product as claimed in claim 16, wherein the bottle is shaped to engage with the frangibly linked portion of the base.

18. A drinking vessel, comprising:

a combined use as a closure device to close and seal a liquids packaging product and as a drinking vessel when not being used as a closure device;

two parts, a first part of said two parts defining a drinking vessel body having a first opening in a first end and a second opening in a second and substantially opposite end, a second part of said two parts defining a drinking vessel base, the drinking vessel base fitted into the second opening in the body and forming a leak resistant seal between the drinking vessel base and the body so that a water tight drinking vessel is only formed when a union is made between the body and the base, the base configured to provide the closure device for the liquids packaging product so as to close and seal the liquids packaging product, the base including a tamper evident seal comprised of a frangibly linked portion which is adapted to (a) engage with the liquids packaging product when the drinking vessel is fitted to the liquids packaging product to seal the liquids packaging product, and to (b) break away from the remainder of the base and to remain with the liquids packaging product when the drinking vessel is subsequently removed from the liquids packaging product, the frangibly linked portion being inside the body when the union is made.

19. The drinking vessel as claimed in claim 18, wherein the frangibly linked portion is engageable with the liquids packaging product, and the frangibly linked portion comprises a ring.

20. The drinking vessel as claimed in claim 18, wherein the frangible link comprises a line of weakness in material joining the frangibly linked portion to a remainder of the base.

* * * * *